US005379670A

United States Patent [19]

Ferry

[11] Patent Number: 5,379,670

[45] Date of Patent: Jan. 10, 1995

[54] GUIDE FOR A MITRE SAW

[76] Inventor: Gordon Ferry, 12210 - 86 Street, Edmonton, Alberta, Canada, T5B 3K9

[21] Appl. No.: 181,240

[22] Filed: Jan. 13, 1994

[51] Int. Cl.[6] ..... B27B 27/06

[52] U.S. Cl. ..... 83/468; 83/468.3; 83/483; 83/581

[58] Field of Search ..... 83/745, 468, 468.3, 83/471.3, 483, 581; 33/806, 809, 811, 807, 808, 421, 419, 430

[56] References Cited

U.S. PATENT DOCUMENTS

| | | | |
|---|---|---|---|
| 2,823,709 | 2/1958 | Konieczka | 83/745 |
| 3,374,545 | 3/1968 | Monroe | 33/74 |
| 3,738,211 | 6/1973 | Carter, Sr. | 83/468 |
| 3,854,360 | 12/1974 | Reed | 83/468 |
| 3,901,498 | 8/1975 | Novak | 269/81 |
| 4,123,955 | 11/1978 | Marlow | 83/435 |
| 4,193,331 | 3/1980 | Gathings | 83/468 |
| 4,557,170 | 12/1985 | Ingham | 83/468 |
| 5,103,566 | 4/1992 | Stebe | 83/745 X |

FOREIGN PATENT DOCUMENTS 0011548 5/1980 European Pat. Off. ..... G01B 3/04

*Primary Examiner*—Rinaldi I. Rada

*Attorney, Agent, or Firm*—Anthony R. Lambert

[57] ABSTRACT

A guide for a mitre saw is described which includes a base having a face with a first side edge, a second side edge, a first edge and a second edge. A guide member is pivotally mounted to the face of the base. The guide member can be locked to the base in a preselected angular position. A telescopic member is secured to the guide member for co-axial telescopic movement. The telescopic member has a mounting pin. A ruler having an elongate mounting slot is telescopically received on the mounting pin. The ruler is movable relative to the mounting pin toward the first side edge and the second side edge of the base within limits defined by the elongate mounting slot. The ruler can be locked to the telescopic member such that the positioning of the telescopic member determines the position of the ruler relative to the first edge and the second edge of the base.

6 Claims, 3 Drawing Sheets

GUIDE FOR A MITRE SAW

BACKGROUND OF THE INVENTION

A variety of guides have been developed which are suitable for use with a mitre saw. Most of these guides are used for cutting picture framing materials at desired angles. Representative of guides suitable for use with mitre saws is U.S. Pat. No. 4,123,955 which was granted to Marlow in 1978 and a 1980 European Patent Office publication 011548 with respect to a patent application filed by Cassese. The Marlow reference discloses a panel-mounted abutment which is setable to a selected calibration. The Cassese reference discloses a ruler which is slidably mounted for movement relative to a saw blade.

The problem with these guides is that they are specifically designed for cutting at a preset angle, usually 45 degrees, and can not readily accommodate other angles.

SUMMARY OF THE INVENTION

What is required is a guide for a mitre saw which is readily adjustable for a variety of cutting angles.

According to the present invention there is provided a guide for a mitre saw which includes a base having a face with a first side edge, a second side edge, a first edge and a second edge. A guide member is pivotally mounted to the face of the base. Means is provided for locking the guide member to the base in a preselected angular position. A telescopic member is secured to the guide member for co-axial telescopic movement. The telescopic member has a mounting pin. A ruler having an elongate mounting slot is telescopically received on the mounting pin. The ruler is movable relative to the mounting pin toward the first side edge and the second side edge of the base within limits defined by the elongate mounting slot. Means is provided for locking the ruler to the telescopic member such that the positioning of the telescopic member determines the position of the ruler relative to the first edge and the second edge of the base.

With the guide for a mitre saw, as described above, the guide member is pivotally movable and can be locked in a preselected angular position. The telescopic member can be telescopically extended to accommodate varying widths of frame. The ruler is movable either toward or away from the saw blade within limits defined by the elongate mounting slot. This combination of features provides tremendous flexibility, enabling different sizes of frames to be cut at differing angles. The guide is also readily transportable from one saw to another.

There are, of course, a number of ways in which to lock the guide member to the plate. Beneficial results have been obtained when the guide member is pivotally mounted to the base by means of a pivot pin having external threads. The means for locking the guide member to the base is a screw-form pivot pin threaded into the base. There are, similarly, a number of ways in which to lock the ruler to the telescopic member. Beneficial results have been obtained when the mounting pin has external threads. The means for locking the ruler to the telescopic member is a clamping member threaded onto the external threads of the mounting pin. There are a number of ways in which the telescopic member can be telescopically mated to the guide member. Beneficial results have been obtained when the guide member has a channel in which the telescopic member is received.

The channel has sidewalls with axially extending tracks. The telescopic member has axially extending peripheral fins which engage the tracks. It is preferable that a scale be positioned on the base in the vicinity of a remote end of the telescopic member. The remote end of the telescopic member has a projecting pointer member which points to the scale thereby visually indicating the angular positioning of the guide member.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
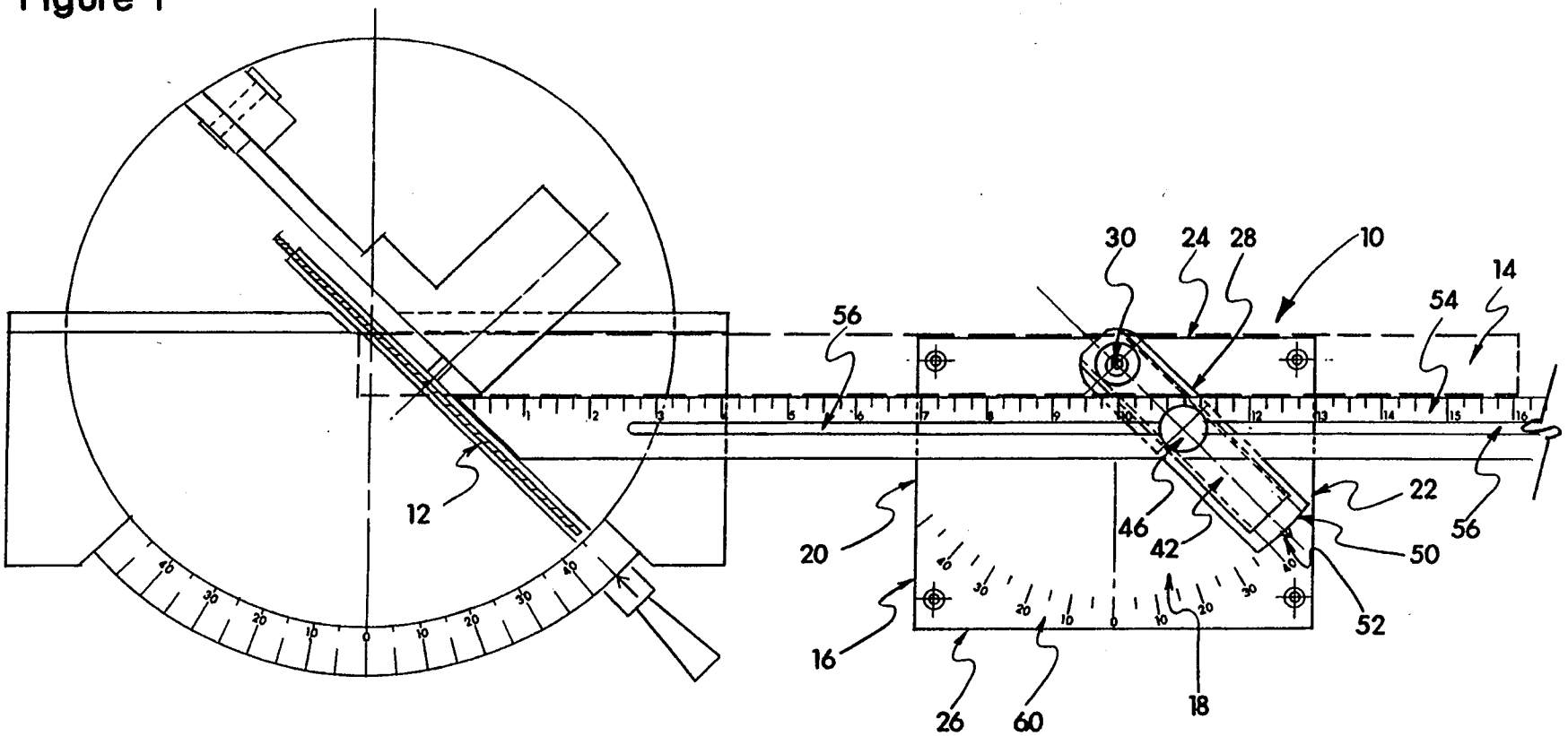
FIG. 1 is a top plan view of a guide for a mitre saw constructed in accordance with the teachings of the present invention in a first angular position.

The preferred embodiment, a guide for a mitre saw generally identified by reference numeral 10, will now be described with reference to FIGS. 1 through 4. Illustrated for the purpose of better described the use of guide 10 is a mitre saw blade 12 with a piece of framing material 14 which is to be cut shown in dotted lines.

Figure 2:
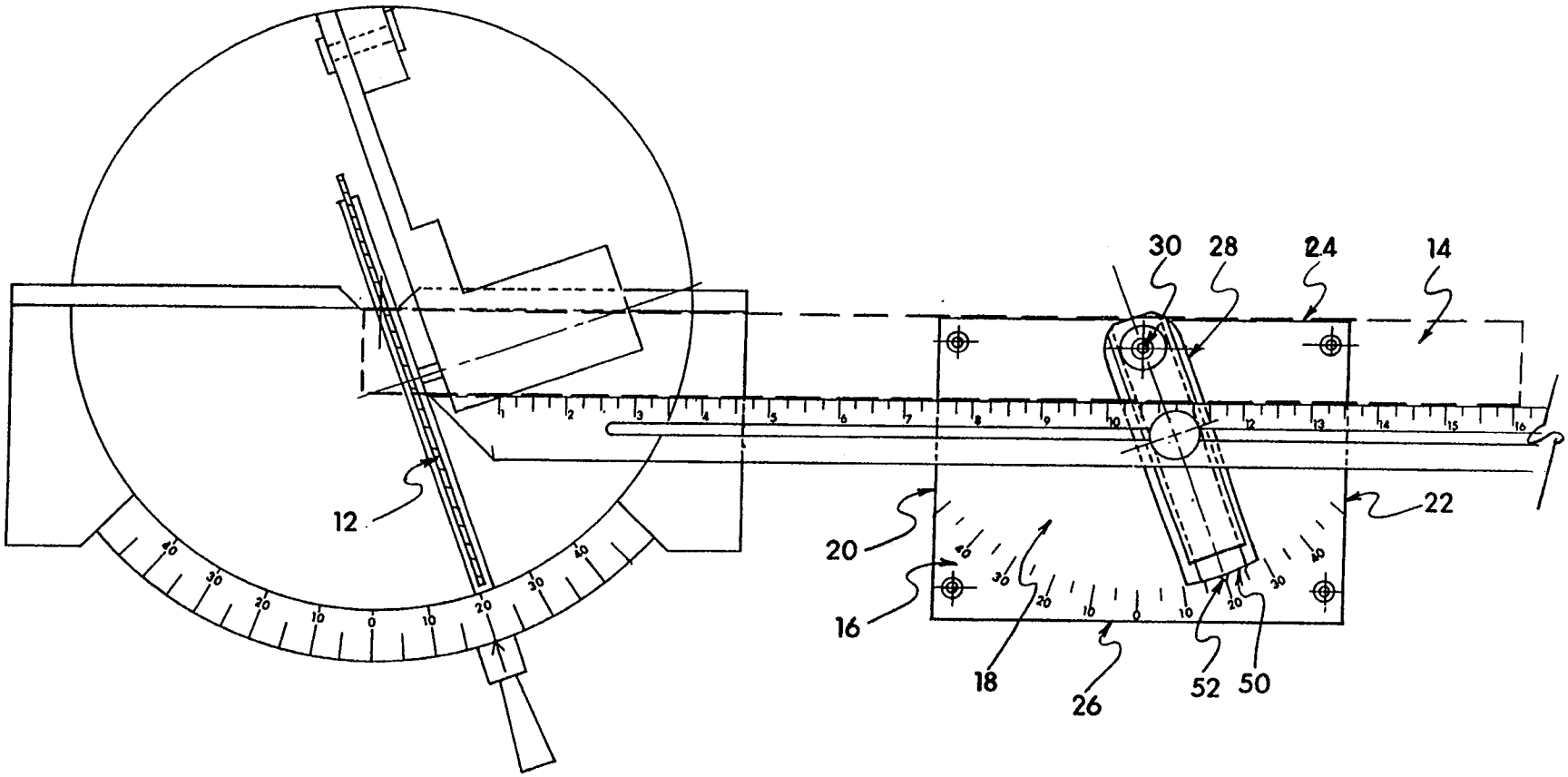
FIG. 2 is a top plan view of the guide for a mitre saw illustrated in FIG. 1, in a second angular position.
Figure 3:
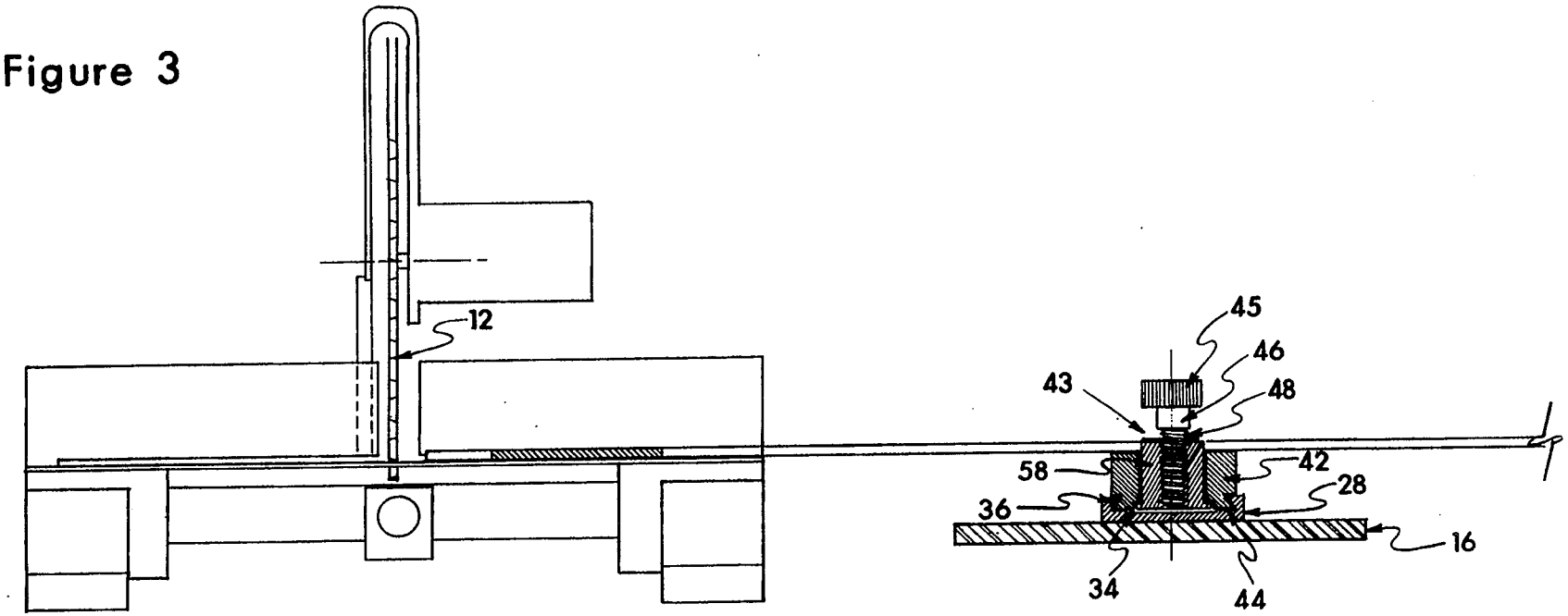
FIG. 3 is a side elevation view in longitudinal section of a portion of the guide for a mitre saw illustrated in FIG. 1.
Figure 4:
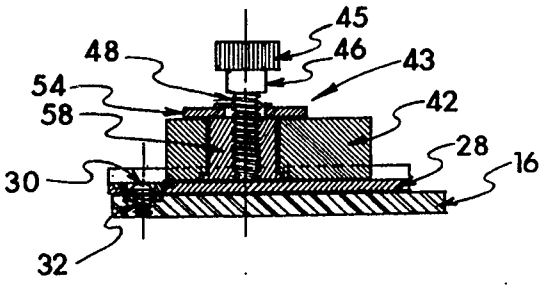
FIG. 4 is an end elevation view in longitudinal section of a portion of the guide for a mitre saw illustrated in FIG. 1.

Referring to FIGS. 1 and 2, guide 10 includes a base 16 which has a face 18 with screw receiving springs 17. Face 18 has a first side edge 20, a second side edge 22, a first edge 24 and a second edge 26. A guide member 28 is pivotally mounted to face 18 of base 16 by a pivot pin 30. Referring to FIG. 4, in the illustrated embodiment pivot pin 30 is in the form of a screw which has external threads 32 which engage base 16. By tightening screw-form pivot pin 30 external threads 32 tightly engage base 16 thereby locking guide member 28 to base 16 in a preselected angular position. Referring to FIG. 3, guide member 28 has an axially extending channel 34. Channel 34 has inwardly and upwardly inclined sidewalls 36 which form axially extending tracks. Referring to FIGS. 1 and 2, a telescopic member 42 is provided. Referring to FIG. 3, telescopic member 42 has axially extending peripheral fins 44 which engage track-form sidewalls 36 in channel 34 of guide member 28 thereby securing telescopic member 42 to guide member 28 for co-axial telescopic movement. Telescopic member 42 includes a screw clamp assembly 43 which has a mounting pin 46 with external threads 48 engaging a clamping member 58. Mounting pin 46 has a knob-like head 45. Referring to FIGS. 1 and 2, telescopic member 42 has a remote end 50 with a projecting pointer member 52. A ruler 54 is provided having an elongate mounting slot 56. Mounting slot 56 telescopically receives mounting pin 46. Ruler 54 is movable relative to mounting pin 46 toward first side edge 20 and second side edge 22 of base 16 within limits defined by mounting slot 56. This movement of ruler 54 has the effect of moving ruler 54 either toward or away from saw blade 12. Referring to FIG. 3, by manipulating knob 45 causes clamping member 58 to move along external threads 48 of mounting pin 46. The tightening of clamping member 58 locks ruler 54 and telescopic member 42 in a fixed position relative to first edge 24 and second edge 26 of base 16. The positioning of ruler 54 is important to accommodate varying thicknesses of frame material 14 as will hereinafter be further described in relation to use and operation of guide 10. A scale 60 is positioned on base 16. Projecting pointes member 52 points to scale 60 thereby visually indicating the angular positioning of guide member 28.

The use and operation of guide 10 will now be described with reference to FIGS. 1 through 4. Prior to use base 16 is secured to a workbench (not shown) by means of screws inserted into screw receiving openings 17. Firstly, saw blade 12 is set to the desired angle. Secondly, guide member 28 is pivoted to a corresponding angle as indicated on scale 60. Guide member 28 is then locked securely in place by tightening screw-form pivot pin 30 into base 16. The manner in which guide 10 accomodates differing angles is apparent from a comparison of FIG. 1, which is set at 45 degrees, and FIG. 2 which is set at 30 degrees. Thirdly, framing material 14 is placed immediately above and parallel to ruler 54, with telescopic member 42 being moved telescopically to accommodate the particular width of framing material 14. The manner in which guide 10 accomodates differing widths of framing material 14 is apparent from a comparison of FIG. 1 which illustrates framing material 14 of one thickness and FIG. 2, which illustrates framing material 14 which is comparatively thicker. Fourthly, ruler 54 is moved relative to mounting pin 46 within limits defined by mounting slot 56, until ruler 54 is immediately adjacent saw blade 12 in a position to measure the length of framing material 14. Ruler 54 is then locked in placed by using knob 45 to tighten clamping member 58 in preparation for a cut being made with saw blade 12. Once ruler 54 is positioned adjacent saw blade 12 all length measurements may be made from saw blade 12 in a conventional manner with reference to ruler 54. It will be apparent to one skilled in the art that modifications may be made to the illustrated embodiment without departing from the spirit and scope of the invention as defined by the claims.

The embodiments of the invention in which an exclusive property or privilege is claimed are as follows:

1. A guide for a mitre saw, comprising:

a. a base having a face with a first side edge, a second side edge, a first edge and a second edge;

b. a guide member pivotally mounted to the face of the base;

c. means for locking the guide member to the base in a preselected angular position;

d. a telescopic: member secured to the guide member for coaxial telescopic movement, the telescopic member having a mounting pin;

e. a ruler having an elongate mounting slot which telescopically receives the mounting pin such that the ruler is movable relative to the mounting pin toward the first side edge and the second side edge of the base within limits defined by the elongate mounting slot; and f. means for locking the ruler to the telescopic member such that the position of the telescopic member determines the position of the ruler relative to the first edge and the second edge of the base.

2. The guide for a mitre saw as defined in claim 1, wherein the guide member is pivotally mounted to the base by means of a screw-form pivot pin having external threads threaded into the base.

3. The guide for a mitre saw as defined in claim 1, wherein the mounting pin has external threads, and the means for locking the ruler to the telescopic member being a clamping member threaded onto the external threads of the mounting pin.

4. The guide for a mitre saw as defined in claim 1, wherein the guide member has a channel in which the telescopic member is received, the channel having sidewalls with axially extending tracks, and the telescopic member having axially extending peripheral fins which engage the tracks.

5. The guide for a mitre saw as defined in claim 1, wherein a scale is positioned on the base in the vicinity of a remote end of the telescopic mender, the remote end of the telescopic member having a projecting pointer member which points to the scale thereby visually indicating the angular positioning of the guide member.

6. A guide for a mitre saw, comprising:

a. a base having a face with a first side edge, a second side edge, a first edge and a second edge;

b. a guide member pivotally mounted to the face of the base by a screw-form pivot pin having external threads, the guide member having an axially extending channel, the channel having inwardly and upwardly inclined sidewalls which form axially extending tracks, the screw-form pivot pin screws into the base, thereby locking the guide member to the base in a preselected angular position;

c. a telescopic member having axially extending peripheral fins which engage the tracks in the channel of the guide member thereby securing the telescopic member to the guide member for co-axial telescopic movement, the telescopic member having a mounting pin with external threads and a remote end with a projecting pointer member;

d. a ruler having an elongate mounting slot which telescopically receives the mounting pin such that the ruler is movable relative to the mounting pin toward the first side edge and the second side edge of the base within limits defined by the elongate mounting slot;

e. a clamping member is threaded onto the external threads of the mounting pin thereby locking the ruler to the telescopic member and the telescopic member in a selected position relative to the guide member such that the position of the telescopic member determines the position of the ruler relative to the first edge and the second edge of the base; and f. a scale positioned on the base in the vicinity of the remote end of the telescopic member such that the projecting pointer member points to the scale thereby visually indicating the angular positioning of the guide member.

* * * * *